US005556515A

United States Patent [19]

Giunta et al.

[11] Patent Number: 5,556,515

[45] Date of Patent: Sep. 17, 1996

[54] COKE OVEN DOOR

[75] Inventors: Joseph S. Giunta, Monroeville; Jerry Hann, North Huntingdon, both of Pa.; John F. McDermott, Columbus, N.C.

[73] Assignee: USX Corporation, Pittsburgh, Pa.

[21] Appl. No.: 339,855

[22] Filed: Nov. 15, 1994

[51] Int. Cl.[6] ..... C10B 25/08; C10B 25/06; C10B 25/16

[52] U.S. Cl. ..... 202/248; 202/242; 110/173 R; 110/242; 122/498; 126/191; 126/192; 432/230

[58] Field of Search ..... 202/245, 246, 202/247, 248, 242; 110/173 R, 242; 122/498; 126/191, 192; 266/286; 432/250

[56] References Cited

U.S. PATENT DOCUMENTS

| | | | |
|---|---|---|---|
| 2,778,784 | 1/1957 | Otto | 202/248 |
| 2,965,550 | 12/1960 | McClure | 202/248 |
| 3,711,380 | 1/1973 | Teplitz | 202/248 |
| 4,016,820 | 4/1977 | Johnson et al. | 110/173 R |
| 4,086,145 | 4/1978 | Muller | 202/248 |
| 4,118,284 | 10/1978 | Bowman et al. | 202/248 |
| 4,119,496 | 10/1978 | Campana | 202/248 |
| 4,125,438 | 11/1978 | Kelly et al. | 202/248 |
| 4,189,457 | 2/1980 | Clement, Jr. | 264/30 |
| 4,200,498 | 4/1980 | Dinello | 202/248 |
| 4,261,797 | 4/1981 | Kelly | 202/248 |
| 4,336,108 | 6/1982 | Dix | 202/248 |
| 4,381,972 | 5/1983 | Stog | 202/248 |
| 4,412,891 | 11/1983 | Abendroth | 202/248 |
| 4,414,072 | 11/1983 | Breidenbach | 202/248 |
| 4,425,191 | 1/1984 | Evans | 201/41 |
| 4,440,600 | 4/1984 | Cantavespre | 202/248 |
| 4,552,623 | 11/1985 | Urbye et al. | 202/248 |
| 4,713,148 | 12/1987 | Offerman | 202/248 |
| 4,744,867 | 5/1988 | Suey | 202/245 |
| 5,158,043 | 10/1992 | Emsbo | 110/173 R |
| 5,238,539 | 8/1995 | Baird | 202/248 |
| 5,443,696 | 8/1995 | Baird et al. | 202/248 |

*Primary Examiner*—N. Bhat

*Attorney, Agent, or Firm*—Armstrong, Westerman, Hattori, McLeland & Naughton

[57] ABSTRACT

A coke oven door, which includes a metal frame, means for latching the door in a closed position, a sealing member extending around the perimeter of the frame having forward edges adapted to contact a sealing surface on a coking chamber door jamb for effecting a continuous seal. The coke oven battery also having at least one attached protrusion proximate the coking chamber extending outwardly from the battery, such as a latch or a guide bar, said door comprising a door plug passing with clearance and fitting into the coke oven, said plug having an inner surface that forms an interior end wall of the coke oven wherein a first plane is formed by the perimeter of said inner surface. Said door further having a first horizontal dimension between said forward edge of said sealing member and said first plane, and said coke oven battery having a second horizontal dimension between the sealing surface on the door jamb and a second plane that is parallel to a plane formed by said sealing surface of the door jamb which includes the furthest point on the protrusion from the sealing surface on the door jamb, wherein the first dimension is greater than the second dimension, so that when the coke oven door is being placed on the coke oven and is improperly aligned, said door plug comes into contact with the coke oven door jamb to stop further movement of the door and prevent the sealing member from coming into contact with the protrusion.

5 Claims, 3 Drawing Sheets

COKE OVEN DOOR

TECHNICAL FIELD

This invention relates generally to coke oven door plugs and more particularly to the plug dimensions whereby a section of the door plug is of such depth as to prevent the door sealing ring from being damaged by striking the latches when placing the door on the oven.

A coke battery is a series of tall and narrow coking chambers separated by heated refractory walls running the length of the chamber. Each chamber is known as an oven. The opposite end of each oven has a door that is closed and sealed for the charging and coking of coal and removed to push the coke from the oven. The interior of the door is refractory lined in the form of a plug projecting into the oven. A function of the plug is to heat the adjacent coal and another is to prevent heat loss through the door.

During the coking cycle large amounts of various gases are evolved from the heated coal and are commonly referred to as coke oven gas. The coke oven gas is removed through the top of each oven through an offtake and into a common collection main. The coke oven gas may also escape from the oven through unintended routes such as charging ports, wall to flue leakage, leveling door seals and door closures. Due to ever increasing environmental restrictions, it is desirable to prevent the escape of coke oven gas from the oven through the door closure or any other part of the oven.

To prevent escape of coke oven gas from the door closures, doors are typically equipped with a sealing member around the periphery of the door. As is well known in the art, the sealing members are fabricated from a heat resistant metal and are usually of the diaphragm type seal or of the S type seal. For the seal to prevent the escape of coke oven gas from the oven to the atmosphere, the forward edge of the sealing member must maintain intimate contact with the door jam around the entire perimeter of the door jam.

The doors are mechanically removed from the oven ends at the end of each coking cycle with heavy equipment that is controlled by an operator and replaced after the coke is pushed from the oven so that a new charge of coking coal can be charged into the oven. During the removal and replacement of the coke oven doors, the door sealing member is subject to mechanical damage from striking protrusions on the battery exterior particularly the door latch hooks. It is desirable to avoid this type of mechanical damage to the door sealing members because a damaged door seal does not seal properly and is a significant source of door seal leaks.

BACKGROUND ART

U.S. Pat. No. 2,965,550 issued to McClure on Aug. 27, 1957, discloses a typical coke oven door having a solid refractory plug, an type seal and adjusting plungers.

U.S. Pat. No. 4,125,438 issued to Kelly et al. discloses a guiding mechanism having tapered guide bars fastened to the door frame. The guide bars are in line with the latch bars and provide assistance in guiding the door onto the oven and accurately positioning the sealing member to provide a seal. Also, the guide bars attached to the door frame are of such length so as to also act as a stop to prevent overloading of the sealing member because the door frame contacts the guide bars when the door is pushed too far into the oven by the door machine. This guiding mechanism is effective only when the initial alignment of the door by the operator is such that the guide bars mate properly. In the event of misalignment by the operator, the guide bars actually cause damage to the sealing member because the sealing member strikes a latch or guide bar. This damage to the sealing member results in an inadequate seal when the door is placed on the oven which results in leakage of coke oven gas to the atmosphere.

Recent and future governmental emission limitations require additional measures to reduce coke oven door emissions. In order to comply with current and future coke oven door emission standards, a design is necessary where sealing member damage is prevented because such damage is a major contributor to coke oven gas emissions from door closures.

DISCLOSURE. OF THE INVENTION

The present invention relates to coke oven doors, more particularly, to the prevention of damage to door sealing members and to maintenance of door plugs. It is desirable that the sealing ring or sealing member surrounding the periphery of the door remains free from damage. Damage typically results from striking objects protruding from the coke oven battery exterior, such as a latch or guide bar, while manipulating the coke oven door onto and off of the coke oven.

According to the present invention, damage to the coke oven door sealing member is avoided by providing a door plug that has a dimension, in the horizontal direction toward the opposing opening of the coke oven chamber, between the forward edge of the sealing member which contacts the door jamb and the door plug interior surface, of sufficient depth such that when a door is being manipulated onto an oven and it is improperly aligned, where further manipulation to place the door on the oven would result in the sealing member striking a protrusion on the battery side wall, the door plug first contacts the door jamb before the sealing member strikes any of the aforementioned protrusions, thus preventing further movement of the door into the oven which would result in damage to the sealing member.

The protection of the sealing member is accomplished by fabricating the door so that the door plug depth, as previously defined, is greater than the length of adjacent protrusions. A protrusion is any object such as a door latch or guide bar, that protrudes in a horizontal direction from the coke battery side wall in the vicinity of the coke oven door jamb. A protrusion's length is measured in the direction normal to the sealing surface of the coke oven door jamb to a plane that is parallel to the plane of the sealing surface and includes the furthest point on the protrusion away from the sealing surface of the coke oven door jamb.

The coke oven door plug can be manufactured from refractory material as a single plug of the appropriate dimensions or a plurality of refractory sections having one or more sections of the appropriate dimensions to accomplish the purpose of the invention.

Additionally, it is necessary to provide for an improved means for removably attaching a refractory door plug to the door frame because the invention causes the refractory door plug to sacrificially incur mechanical damage as opposed to the sealing member. As a result, it can be anticipated that over time the refractory door plug will be damaged and require more frequent replacement. A retainer is attached to the door body in such a way that a single retainer, including the refractory plug that is attached to the retainer, may be quickly and easily removed from the door body without removing or disturbing the sealing member.

DESCRIPTION OF THE PREFERRED EMBODIMENT

Figure 1:
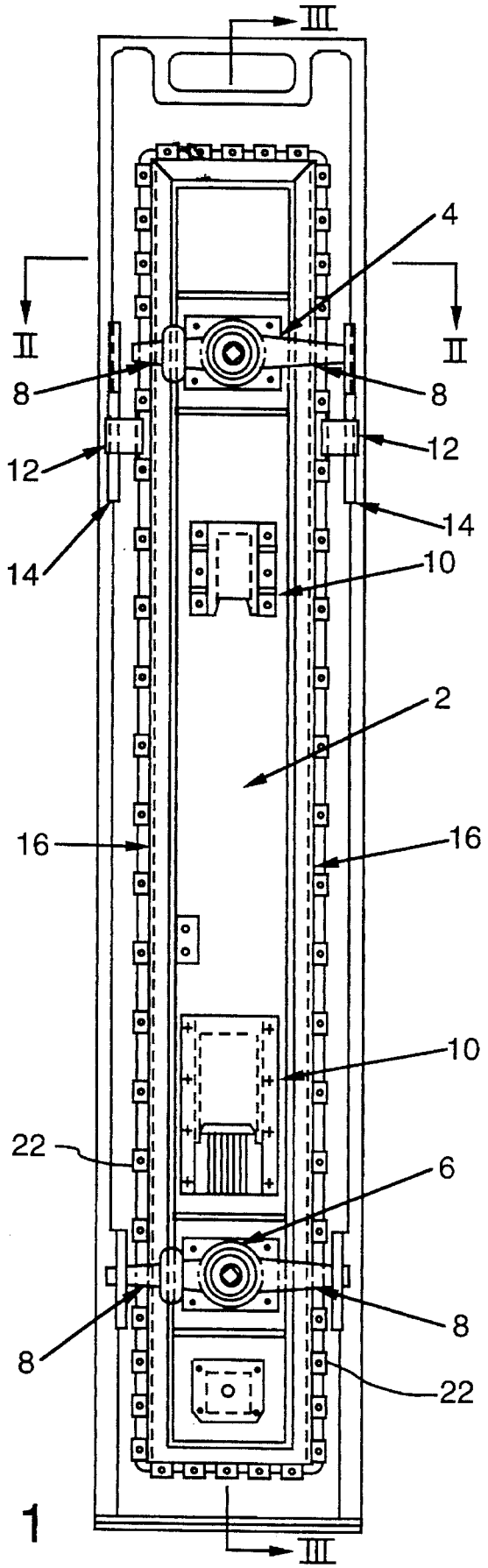
FIG. 1 is a view of the exterior of a coke oven door.

Referring to FIG. 1, the exterior of a coke oven door (2) is shown. The door has an upper rotatable latching member (4) and a lower rotatable latching member (6). Each of the latching members have opposing elongated arms (8) extending from the central axis about which the latching member rotates. The latching member also has spring means for biasing the door to securely mate the sealing member with the door jamb.

The doors are equipped with lifting assemblies (10) that a door machine or pusher machine grasps for removing or replacing oven doors. Typically, the door has a pair of opposing ears (12) protruding horizontally from the door sides (16) that rest upon mating protrusions (14) extending perpendicularly from the battery's side structure. When the door is placed on the oven, the ears support the door and provide for proper alignment of the door on the oven.

Figure 2:
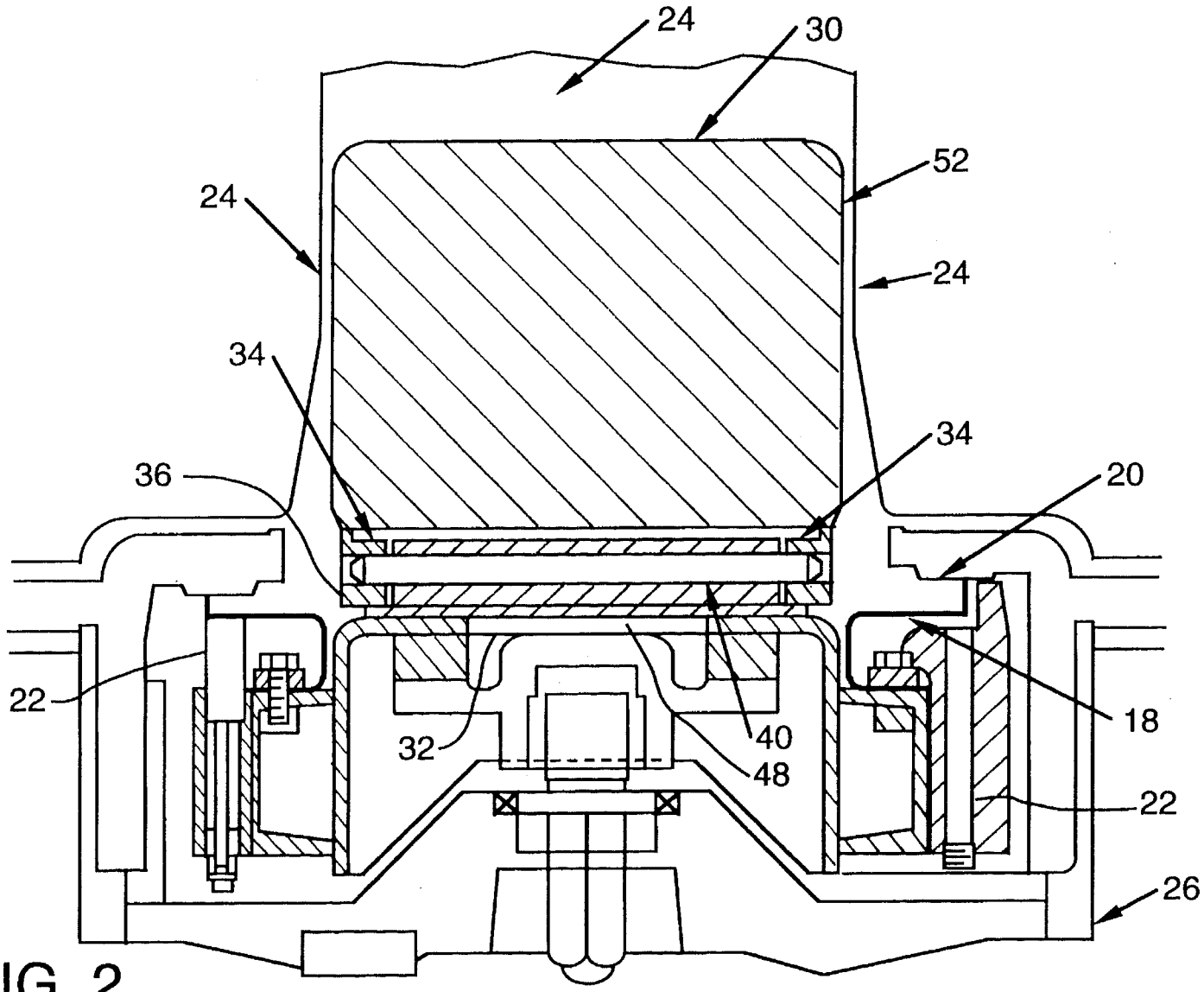
FIG. 2 is a sectional view of the coke oven door at II—II.

FIG. 2 shows each door has a resilient sealing member (18) that extends along the periphery of the door in order to seal the door when it is placed onto the oven. The sealing member may be of the S type (18) or the diaphragm type (not shown) as they are commonly known in the industry. The forward edge of the sealing member engages a flat surface on the door jamb (20) which is a metal structure that surrounds the external opening of the coke oven chamber. The rotatable latching member has spring means (not shown) within the assembly that biases the door and forces the sealing member into intimate contact with the door jamb when the door is placed onto the oven and the latching arms are rotated and held within the latches.

The doors are also provided with a plurality of adjustable plungers (22) that can be individually adjusted to cause the sealing member to conform to the shape of the door jamb should the sealing member or jamb become irregular in shape.

Figure 3:
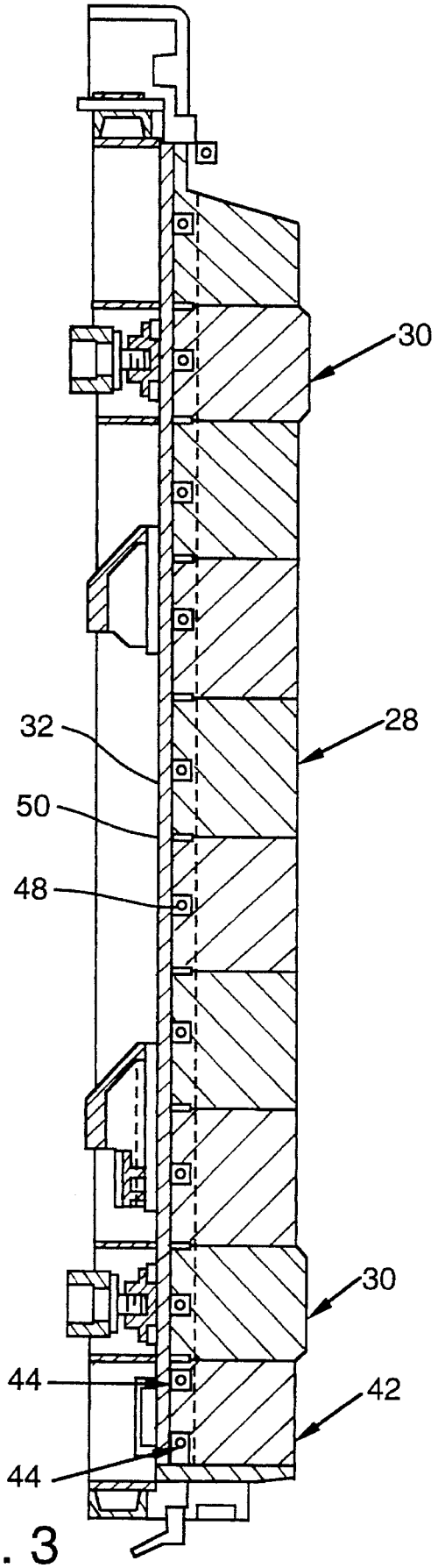
FIG. 3 is a sectional view of the coke oven door at III—III.

As shown in FIG. 3, the doors are also equipped with elongated refractory door plugs (28) that are attached to the interior surface of the door. When a door is on the oven in the closed position, the plug extends from the interior surface of the door and fits with clearance into the oven. The plug refractory reduces the heat loss from the coke oven thereby maintaining the high coke oven temperature in the area adjacent to the door. The plug refractory also insulates the structural components of the door from the high coke oven temperatures to prevent thermal damage to the door structure.

When a door has been removed from an oven chamber (24) and is being replaced, an operator must visually align the door with the oven chamber using judgment, which can be aided by one or more spotting devices to assist in properly aligning the door with the oven chamber opening. Devices such as eyesights or guidebars (26) are utilized to provide an operator with assistance. However, when misalignment of the door occurs, the sealing member may strike the latching member protruding from the battery, the guidebars, or other protrusions, and cause damage to the sealing member. The resulting damage to the sealing member causes insufficient engagement of the sealing member with the door jamb and allows coke oven gas to leak to the atmosphere through the damaged area.

To prevent this type of damage, according to the preferred embodiment of this invention, a door is equipped with a refractory door plug that has eight sections (28) of substantially similar dimensions and two plug sections of larger dimensions (30). The two plug sections of larger dimensions are located opposing the latching locations and have a first horizontal dimension, in the direction toward the opposing oven opening, that is larger than the remainder of the sections of refractory plugs and the larger plugs having greater depth function to protect the sealing ring from damage such that when a door is being placed onto an oven and it is misaligned, whereupon further placement onto the oven would result in the sealing member striking a latch, guidebar or other object protruding from a battery sidewall, the perimeter of the interior face of the guide plug makes contact with the door jamb before the sealing member strikes a protrusion, preventing the door from being inserted further into the oven and thus preventing the sealing member from striking any of the aforementioned protrusions and preventing damage to the sealing member.

The protection of the sealing member is accomplished by fabricating the door, door seal and refractory plug to have dimensional relationships whereby the first horizontal dimension is greater than a second horizontal dimension, in a direction perpendicular to the door jamb sealing surface, between the sealing surface on the door jamb and a plane that is parallel to a plane formed by said sealing surface of the door jamb and which includes the furthest point on the protrusion from the sealing surface on the door jamb.

The large guide plug section is preferably fabricated from a refractory material which has superior mechanical and shock resistant properties such as a refractory material having low moisture refractory castable with an alumina content greater than sixty five percent, a phosphate bonded rammed plastic refractory castable having an alumina content greater that sixty five percent, as opposed to a refractory material possessing superior insulating properties, which are preferable for the remaining plug sections or a fused silica refractory.

In order to facilitate quick removal of door plug sections to replace sections that are damaged by striking the door jamb, each refractory door plug section is a fabricated unit that can be individually removed from the coke oven door. The refractory material of the plug is fastened to a retainer (36) by conventional means as is well known in the art. The retainer is made from a steel angle in the shape of a rectangle and has two clevis-like members having axially aligned openings (34) and in centrally located on opposing sides. The refractory fastened to the retainer is fabricated to have a slot to permit the engagement of an elongated clevis member having an opening therethrough (48). Said elongated clevis-like member that is mounted on the adapter plate (32) which is fastened to the interior face (50) of the coke oven door frame. The retainer is matingly engaged with the adapter plate such that the elongated clevis-like member opening aligns with the opening in the two clevis-like members on opposing sides of the retainer and are secured by passing a pin (40) therethrough. To ensure ease of removal the exposed pin ends are covered with a refractory mortar. The door plug sections can be individually removed from the door without removing the sealing member or adjacent plug sections by removing the pin from the openings.

Each door plug section requires one clevis and pin assembly to fasten it to the interior of the coke oven door. The plug at the bottom of the door (42) is preferably fabricated to have two clevis and pin assemblies (44) and a shoeplate (46) on the bottom of the retainer. While the preferred embodiment of our invention is shown, it will be apparent to those skilled in the art, that other adaptations and modification may be made without departing from the scope of the following claims:

We claim:

1. A removable coke oven door for a coking chamber within a coke oven battery, which includes a metal frame, means for latching the door in a closed position, a sealing member extending around the perimeter of the frame having forward edges adapted to contact a sealing surface on a coking chamber door jamb for effecting a continuous seal, the coke oven battery also having at least one attached protrusion extending outwardly from the battery proximate the coking chamber, said door comprising a door plug having edges passing with clearance and fitting into the coking chamber, said plug having a refractory inner surface that forms an interior end wall of the coking chamber, said inner surface having a raised portion adjacent and spaced from the edges of the door and wherein a first plane is formed by the perimeter of an innermost edge of the raised portion of said inner surface, said door further having a first horizontal dimension extending in a direction of a length of the coking chamber and between said forward edges of said sealing member and said first plane, and said coke oven battery having a second horizontal dimension extending in a direction of a length of the coking chamber and between the sealing surface on the door jamb and a second plane that is parallel to a plane formed by said sealing surface of the door jamb and which second plane includes the furthest point on the protrusion from the sealing surface on the door jamb, wherein the first dimension is greater than the second dimension, so that when the coke oven door is being placed on the coking chamber and is improperly aligned, the raised portion of the inner surface of said door plug comes into contact with the coking chamber door jamb to stop further movement of the door and prevent the sealing member from coming into contact with the protrusion.

2. A coke oven door according to claim 1, wherein said door plug has a plurality of door plug refractory sections and wherein at least two refractory sections adjacent and spaced from bottom and top door plug edges have a larger dimension in the direction of a length of the coking chamber than the other sections and wherein innermost edges of the perimeter of the two larger sections define a first plane, a first horizontal dimension extending in a direction of a length of the coking chamber and between said forward edges of said sealing member and said first plane, and said coke oven battery having a second horizontal dimension extending in a direction of a length of the coke chamber and between the sealing surface on the door jamb and a second plane that is parallel to a plane formed by said sealing surface of the door jamb and which second plane includes the furthest point on the protrusion from the sealing surface on the door jamb, wherein the first dimension is greater than the second dimension, so that when the coke oven door is being placed on the coking chamber and is improperly aligned, said larger refractory sections of said door plug come into contact with the coking chamber door jamb to stop further movement of the door and prevent the sealing member from coming into contact with the protrusion.

3. A coke oven door according to claim 2, wherein said larger door plug sections are of a refractory material selected from the group consisting of low moisture refractory castable having an alumina content greater than sixty five percent, phosphate bonded rammed plastic refractory castable having an alumina content greater than sixty five percent and fused silica.

4. A coke oven door according to claim 2, wherein the door plug refractory sections extend the height of the door and further comprising an adapter plate removably mounted on the door and a generally rectangular retainer attached to the adapter plate and in which retainer the door plug refractory sections are individually mounted by removable fastening means so that each section is removable without prior removal of the sealing member or adjacent plug sections.

5. A coke oven door according to claim 4, wherein each of said door plug refractory sections has a slot along one side opposite an inner face of the plug, and said fastening means for each section comprises two first clevis members fixedly attached to said retainer on opposite sides thereof and having axially aligned openings, a second, elongated clevis member having an opening therethrough and mounted on the adapter plate such that the opening in the second clevis member is aligned with the openings in the first clevis members and the second clevis member is engaged with the slot in a corresponding plug section, and a pin extending through the openings in the first and second clevis members, whereby by removing the pin from the openings each door plug section can be individually removed from the door without removing the sealing member or adjacent plug sections.

* * * * *